US005603344A

United States Patent [19]

Hall, Jr.

[11] Patent Number: 5,603,344

[45] Date of Patent: Feb. 18, 1997

[54] APPARATUS FOR RECOVERING AND SAVING CHILLED WATER IN HOT WATER LINES HAVING ADJUSTABLE THERMOSTATIC CONTROL

[76] Inventor: John E. Hall, Jr., P.O. Box 1445, Ruidoso, N.M. 88345

[21] Appl. No.: 634,291

[22] Filed: Apr. 18, 1996

[51] Int. Cl.[6] ..... F24H 1/00

[52] U.S. Cl. ..... 137/2; 137/337; 137/569; 417/292; 126/362

[58] Field of Search ..... 137/2, 337, 569; 417/32, 46, 292; 126/362

[56] References Cited

U.S. PATENT DOCUMENTS

| | | | |
|---|---|---|---|
| 2,935,078 | 5/1960 | Greenland et al. | 137/569 |
| 4,141,222 | 2/1979 | Ritchie | 126/362 |
| 4,750,472 | 6/1988 | Fazekas | 126/362 |
| 4,893,749 | 1/1990 | Schichl | 137/564 |
| 4,945,942 | 8/1990 | Lund | 126/362 |
| 5,009,572 | 4/1991 | Imhoff et al. | 417/32 |
| 5,105,846 | 4/1992 | Britt | 137/337 |
| 5,277,219 | 1/1994 | Lund | 137/337 |

FOREIGN PATENT DOCUMENTS

| | | | |
|---|---|---|---|
| 1687876 | 10/1991 | U.S.S.R. | 417/292 |

*Primary Examiner*—A. Michael Chambers
*Attorney, Agent, or Firm*—Mallinckrodt & Mallinckrodt

[57] ABSTRACT

A water saving device for use with domestic hot water systems of the noncirculating storage tank heater type uses a hydraulic motor to drive a water pump to pump water from the hot water pipe to a cold water pipe. Pumping begins when a hot water tap connected to the device is turned on and the water in the hot water pipe is cold. Pumping continues until a temperature sensing element senses that hot water has reached the water saving device and actuates a valve. When hot water is present at the device, the valve permits the hot water to pass directly to the tap instead of driving the hydraulic motor.

19 Claims, 5 Drawing Sheets

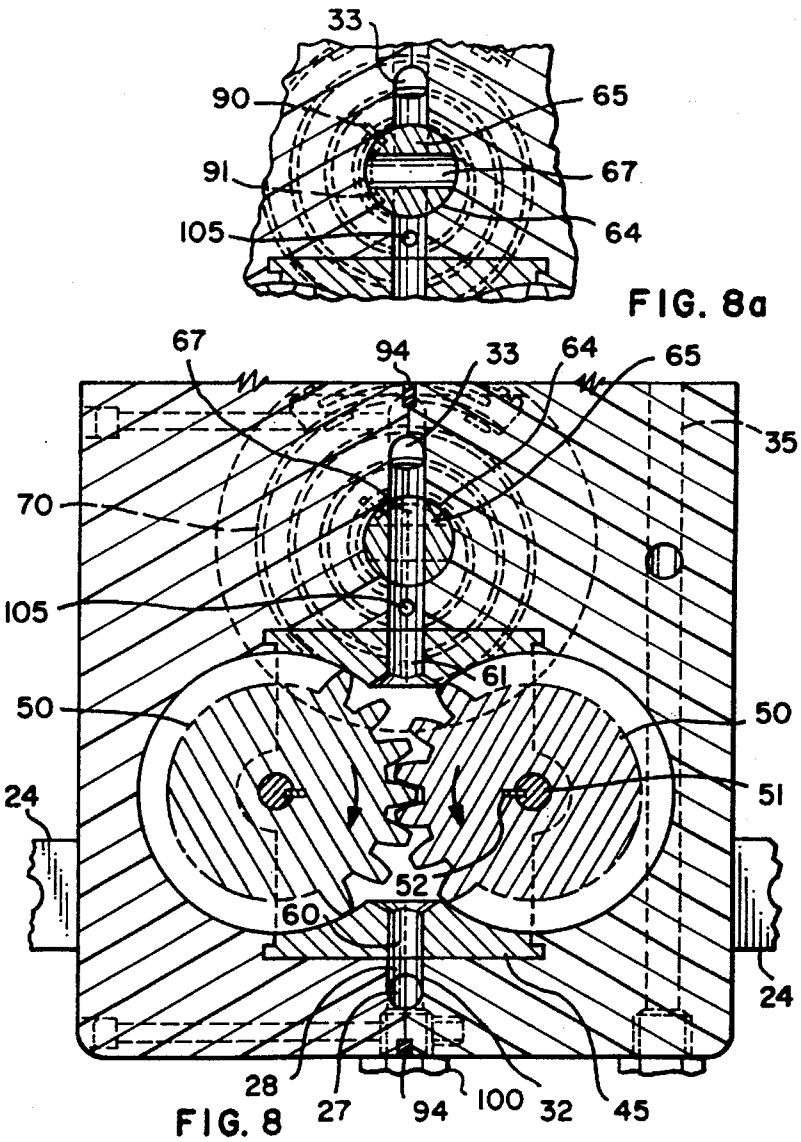
FIG. 8a
FIG. 8
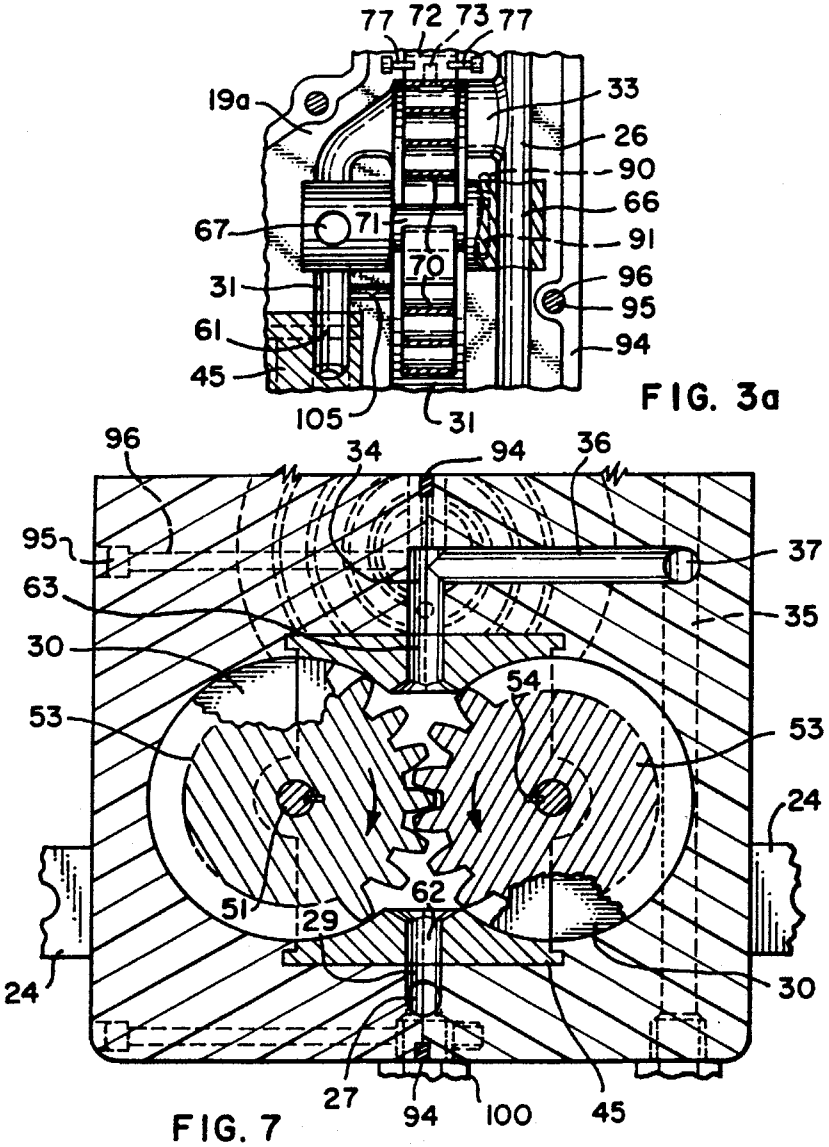
FIG. 3a
FIG. 7

APPARATUS FOR RECOVERING AND SAVING CHILLED WATER IN HOT WATER LINES HAVING ADJUSTABLE THERMOSTATIC CONTROL

BACKGROUND OF THE INVENTION

1. Field

The present invention relates to the field of water conservation as applied to residential hot water plumbing of the non-circulating storage tank heater type.

2. State of the Art

Virtually all household hot water systems used in the United States use a central storage-tank type water heater. Each such heater comprises a device for applying heat energy to water, and an insulated storage tank for the heated water. Typically households are equipped with a single storage tank heater, having a capacity of from 15 to 60 gallons, from which hot water is piped to the various locations at which it may be used.

When hot water is not being drawn from a central storage-tank type water heater, the pipes, with the water in them, leading from the heater will cool to the temperature of the surrounding environment, the ambient temperature. When a consumer opens a hot water tap, water is received at the ambient temperature. Hot water of the desired temperature only reaches the tap after the cooled water is removed from the pipes, and enough hot water has flowed through the pipes to warm the pipes.

The initial water drawn from the hot water tap, the cool water at ambient temperature, is often wasted. Waste often occurs when typical consumers take showers. A consumer will turn on the hot water tap, allowing the water received to run down the drain. When the water at ambient temperature is purged from the pipes, and hot water reaches the tap, the consumer will adjust the temperature and enter the shower. Other consumers may turn on the hot water, allowing water to flow down the drain, while performing some unrelated task. Sometime later, after hot water has reached the tap, the consumer will return to the shower, adjust the temperature, and begin the shower. This not only wastes water, but increases the load on the sewage system being used because of the increase in volume of liquid sewage to be treated.

Experiments at the inventor's residence showed that about 4.3% of the inventor's domestic water consumption for a family of two people, or about 4.5 gallons per day, may be wasted in this manner. A larger family will have greater waste. It is therefore advantageous if the loss of some of this water can be prevented.

The amount of water wasted while purging hot water pipes can be reduced through use of a demand-type water heater located close to the tap. Multiple demand-type water heaters are often required if water wastage is to be eliminated because the various taps are not always located close to each other. Further, demand-type water heaters are usually electric water heaters and are significantly less efficient than natural gas fired heaters of the storage tank type.

Another method for reducing the amount of water wasted while purging pipes is the continuously circulating hot water system. With this system, the pipes leading from the hot water heater are arranged in a loop, passing near each tap, with a return pipe to the hot water heater. A pump is inserted in the loop to keep hot water flowing through the loop, thereby keeping the pipes and the water in them at a high temperature. This system is less energy efficient than the typical system because of the heat radiation from the pipes, and is difficult to retrofit to existing buildings. This system is nonetheless common in large buildings with many bathrooms such as hospitals.

U.S. Pat. No. 5,277,219, issued to Lund on Jan. 11, 1994, shows a water saving hot water system wherein an electric pump is used to pump ambient temperature, cool water from the hot water pipe into the cold water pipe. A switch is pressed to turn on the pump when hot water is desired. The pump turns off when a temperature sensor detects that the cool water has been purged from the hot water pipe. A similar system is portrayed in U.S. Pat. No. 5,105,846, issued to Britt on Apr. 21, 1992, in which a timer shuts off the electric pump. Yet another such system is portrayed by U.S. Pat. No. 5,009,572, issued to Imhoff on Apr. 23, 1991. Since the typical residential hot water system is fed from the same potable water source as the cold water system and the hot and cold water is typically at approximately the same static pressure, pumping the cool water from the hot water pipe into the cold water pipe is a reasonable way to conserve this cool water. However, systems using electrical pumps require electrical power to operate the pumps which offsets any savings realized due to saving water. Further, such systems are somewhat complex to install, maintain, and operate.

SUMMARY OF THE INVENTION

According to the invention, a hydraulically powered pump is provided to pump cool water from the hot water pipe to the cold water pipe until water in the hot water pipe reaches a desired temperature. The pump is powered by allowing some of the water from the hot water pipe to escape-through the hot water tap. This escaping water, usually about one-quarter the normal flow from the tap, is sufficient to pump the remaining about three-quarters of the normal flow from the hot water pipe into the cold water pipe. Thus, about seventy-five percent of the water normally wasted is saved. The twenty-five percent which does flow out of the tap to power the pump will generally represent a lower resource use than the electricity used by an electric pump to save all of the water. In addition, the device of the invention is self-contained and easier to install and use than a system that requires electrical power.

A preferred embodiment of the invention uses a hydraulic gear motor and gear pump to recover about 75% of the cool water that would otherwise be discarded. About one-fourth of the water flow from the hot water pipe runs through the gear motor, around a bimetallic thermostat element which controls a flow control valve, and is vented out the tap. This flow drives the gear pump that pumps the remaining about 75% of the flow from the hot water pipe into the cold water pipe. When the cool water is purged from the hot water pipe and warm water reaches the bimetallic thermostat element, the bimetallic thermostat element operates a valve to permit all of the water in the hot water pipe to flow from the tap. A control permits adjustment of the temperature at which the bimetallic thermostat element turns the valve.

THE DRAWINGS

The best mode presently contemplated for carrying out the invention is illustrated in the accompanying drawings, in which:

FIG. 1 is a perspective view of a water saving device of the present invention;

FIG. 2, a front elevation of the present invention, showing the hot and cold water inlets and outlets and the control knob and showing interior parts of the device in broken lines;

FIG. 3, a vertical section taken on the line 3—3 of FIG. 2, showing the valve of the device in the pumping position;

FIG. 3*a*, a fragmentary vertical section of the valve of the device as shown in FIG. 3, but showing the valve in the normal flow position;

FIG. 4, a longitudinal section taken on the line 4—4 of FIG. 2, showing the valve in the pumping position;

FIG. 4*a*, a fragmentary longitudinal section of the valve of the device as shown in FIG. 4, but showing the valve in the normal flow position;

FIG. 5, a longitudinal section taken on the line 5—5 of FIG. 2, showing the gear pump and motor;

FIG. 6, a vertical section taken on the line 6—6 of FIG. 3, showing the bimetallic thermostat element and the engagement of the thermostat element with the temperature adjustment knob;

FIG. 7, a vertical section taken on the line 7—7 of FIG. 3, showing the pumping gears of the present invention;

FIG. 8, a vertical section taken on the line 8—8 of FIG. 3, showing the motor gears of the present invention, and the valve in the pumping position;

FIG. 8*a*, a fragmentary vertical section of the valve of the device as shown in FIG. 8, but showing the valve in the normal flow position;

FIG. 9, an exploded assembly view of the motor and pump of the present invention;

FIG. 10, a schematic view showing the bimetallic thermostatic element at low temperature with the valve in the pumping position, and the temperature setting at normal;

FIG. 11, a schematic view similar to that of FIG. 10, but showing the bimetallic thermostatic element at high temperature with the valve in the normal flow position, and the temperature setting at normal;

FIG. 12, a schematic view showing the bimetallic thermostatic element at low temperature with the valve in the pumping position, and the temperature setting at low;

FIG. 13, a schematic view similar to that of FIG. 12, but showing the bimetallic thermostatic element at high temperature with the valve in the normal flow position, and the temperature setting at low;

FIG. 14, a schematic view showing the bimetallic thermostatic element at low temperature with the valve in the pumping position, and the temperature setting at high;

FIG. 15, a schematic view similar to that of FIG. 14, but showing the bimetallic thermostatic element at high temperature with the valve in the normal flow position, and the temperature setting at high;

FIG. 16, a schematic, exploded assembly view showing the thermostatic element, valve, motor gears, and pumping gears, and showing the water flow through the device when the valve is in the pumping position; and FIG. 17, a schematic, exploded assembly view similar to that of FIG. 16, showing the water flow through the device when the valve is in the normal flow position.

DETAILED DESCRIPTION OF THE ILLUSTRATED EMBODIMENT

The water saving device of the present invention is connected in the hot and cold water lines leading to hot and cold water taps. When the hot water tap is turned on and water in the hot water line at the device has cooled so is not at a desired hot temperature, a small portion of the water from the hot water line which usually flows from the tap flows through a hydraulic motor and out the tap. The hydraulic motor operates a pump to pump the larger portion of the water which usually flows from the tap into the cold water line. This continues until the water in the hot water line at the device has reached a preset temperature at which time full flow of water from the hot water tap is restored.

Figure 1:
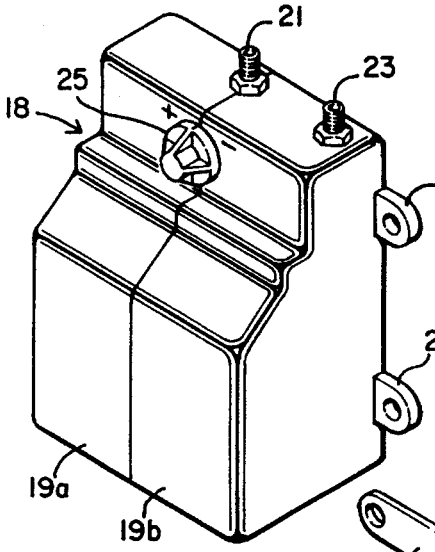

The water saving device of the illustrated embodiment includes housing 18 formed of housing halves 19*a* and 19*b*, FIG. 1, having a hot water inlet 20, FIGS. 2, 3, 16, and 17, a hot water outlet 21, a cold water inlet 22, and a cold water outlet 23. A pair of mounting lugs 24 extend from each side of housing 18 whereby the device may be mounted to a wall or other surface. A temperature adjustment knob 25 extends from the housing to be accessible by a user. In operation, the device of the invention is mounted close to a sink, basin, tub, shower, or other location where hot and cold water is normally used, and the device is connected in the hot and cold water lines. For example, the device may be mounted on a building wall or the back wall of a cabinet under a kitchen sink or bathroom basin. The hot water inlet 20 is connected to the hot water supply pipe (not shown) conducting water from the hot water outlet of a storage tank type water heater (not shown), and the hot water outlet 21 is connected to the hot water tap (not shown). The cold water inlet 22 is connected to the cold water supply pipe (not shown) that is generally also connected to the cold water inlet of the water heater (not shown). The cold water outlet 23 is connected to the cold water tap (not shown).

Figure 4:
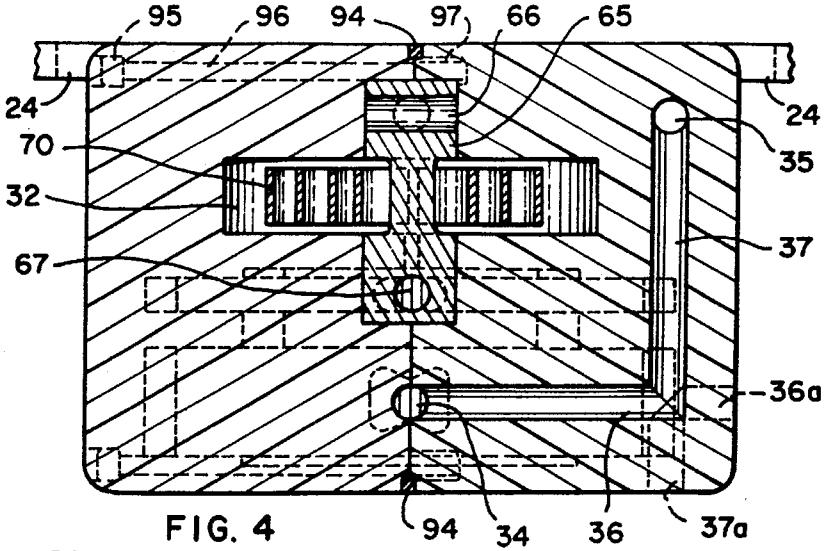

The housing halves 19*a* and 19*b* may be formed of solid material, such as plastic, with various flow passages and receiving compartments molded or milled and drilled therein. When molded of plastic, each of the halves 19*a* and 19*b* will have mating passage halves molded into the mating surface of the halves so that when the halves are joined together they form a hot water through passage 26, a lower hot water bypass passage 27 extending from the hot water through passage 26 and having outlet branches 28 and 29 opening into a compartment 30 adapted to receive a hydraulic motor and pump assembly therein, an upper hot water bypass passage 31 extending from compartment 30 to a compartment 32, opening 33 connecting compartment 32 to hot water through passage 26, and stub passage 34 extending a short distance from compartment 30 opposite branch 29. Housing half 19*b* additionally has a cold water through passage 35 formed therein, such as by drilling, with a passage 36, see particularly FIGS. 4 and 7, extending from stub passage 34 to connection with passage 37 to connect stub passage 34 to cold water through passage 35. These passages 36 and 37 may be drilled into half 19*b* from the outside with portions 36*a* and 37*a*, FIG. 4, being filled in or otherwise plugged after drilling.

The hydraulic motor and pump assembly of the illustrated embodiment comprise a gear type motor and a gear type pump. A gear type motor requires that the teeth of two meshing gears form a seal. Water under pressure is introduced into the space between the gears as they move apart, filling the space between the teeth. Water is released into a lower pressure outlet from the space where the teeth move together.

Figure 9:
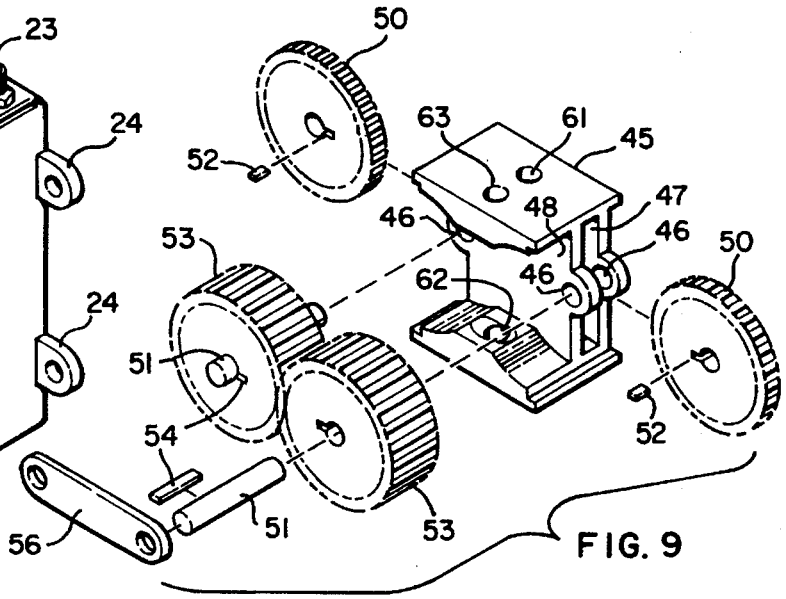
Figure 5:
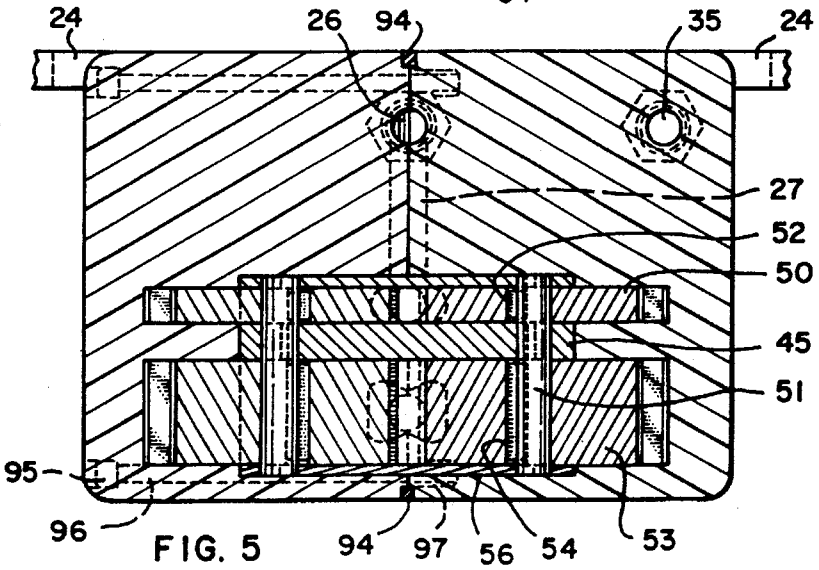
Figure 4A:
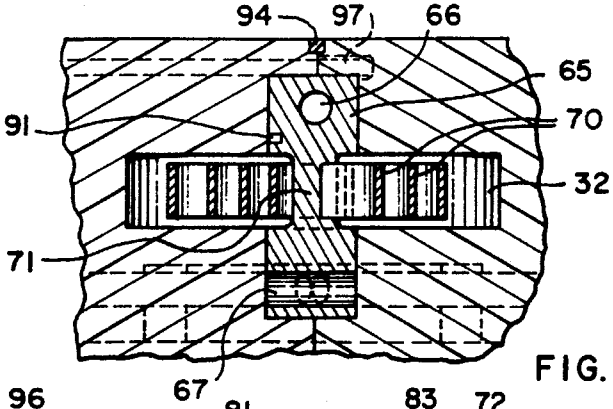

The hydraulic motor and pump assembly, as best shown in FIG. 9, includes a bearing body 45 with pairs of shaft mounting holes 46 at opposite sides of the body, a motor gear compartment 47, and a pump gear compartment 48. Motor gears 50 are placed in the motor gear compartment 47, and keyed to respective axles 51 with keys 52. A pair of pump gears 53 are keyed to the same axles 51 with keys 54 such that rotation of the motor gears will cause rotation of the pump gears. A securing strap 56 is attached over the ends of the axles to hold the axles at the correct distance from each other and form end bearings. The motor and pump assembly is installed within appropriately shaped receiving compartment 30 in housing halves 19*a* and 19*b*, with the housing halves locating and holding strap 56 in proper position, see FIGS. 3 and 5.

Figure 3:
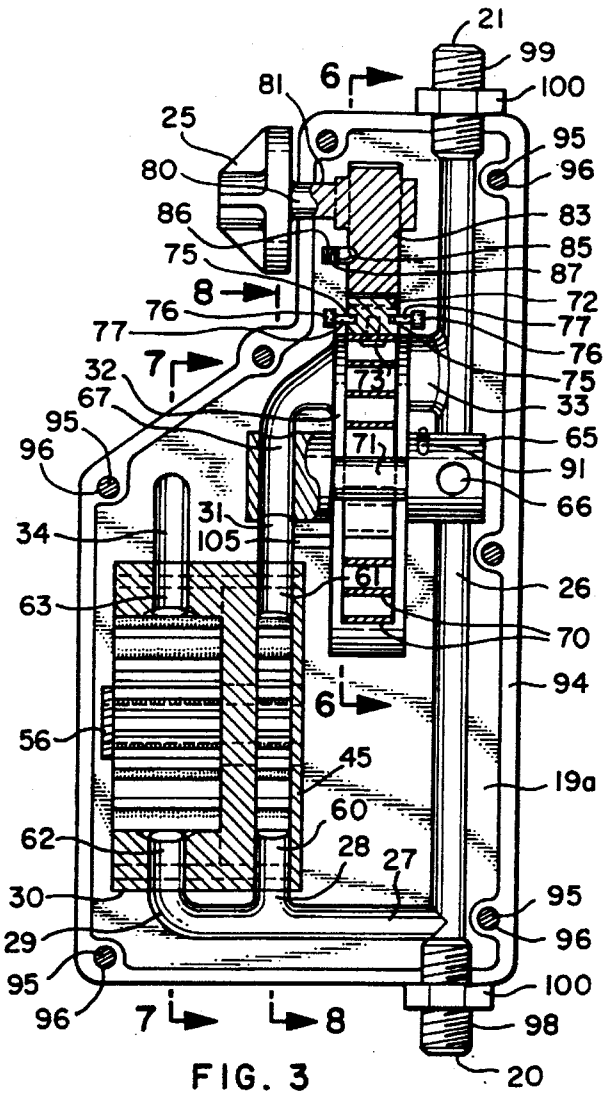
Figure 2:
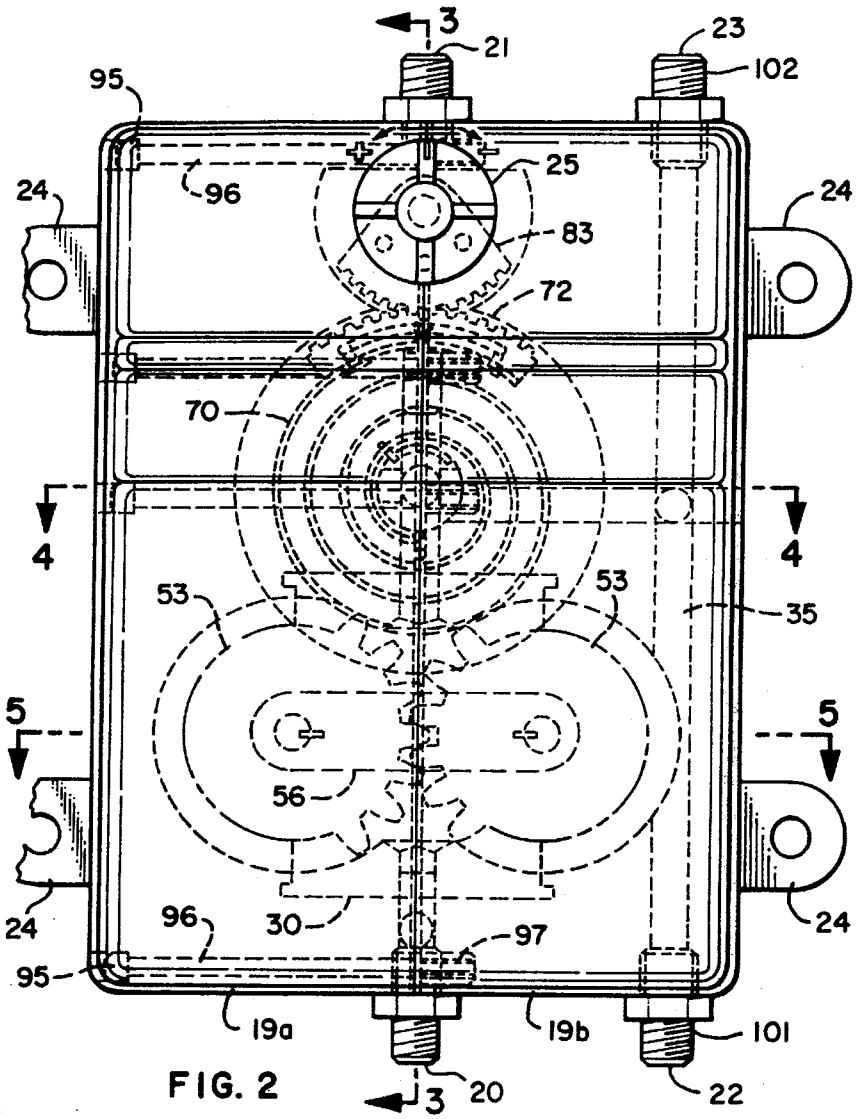

It should be noted that bearing body 45 includes a motor inlet opening 60, FIGS. 3 and 8, which, with bearing body 45 inserted in receiving compartment 30, is aligned and in flow communication with bypass branch passage 28 in body halves 19*a* and 19*b*. Similarly, bearing body 45 has a motor outlet opening 61, FIGS. 3, 8 and 9, which is aligned with bypass passage 31, a pump inlet opening 62 which is aligned with bypass branch 29, FIGS. 3, 7 and 9, and a pump outlet opening 63 aligned with stub passage 34.

As shown, pump gears 53 are wider than motor gears 50. The relative widths of the gears determine generally the proportion of water flow through each. If the pump gears and motor gears are of equal width, approximately the same amount of water will flow through the pump and through the motor. With the pump gears three times the width of the motor gears, as presently preferred, about a third as much water passes through the pump as through the motor. This results in the flow through the motor being about one-quarter of the total combined flow through the motor and the pump. Gear widths and flow proportions can be adjusted as desired.

Housing halves 19*a* and 19*b* include on their mating faces grooves which form a receiving passage 64, FIGS. 8 and 8a, for rotatably receiving a cylindrical valve spool member 65 which extends through receiving compartment 32 and into hot water through passage 26 on one side of compartment 32 and upper bypass passage 31 on the opposite side of compartment 32. Valve spool member 65 includes a passage 66 therethrough in the portion thereof aligned with hot water through passage 26 and a passage 67 extending through the portion thereof aligned with upper bypass passage 31. Valve spool member passages 66 and 67, while in parallel planes, extend in different directions. As shown, passage 66 extends in a direction rotated 90° from the direction of passage 67. Thus, when valve spool member 65 is rotated so that spool member passage 67 is aligned with upper bypass passage 31 as shown in FIG. 3 to thereby open and allow flow through passage 31, spool member passage 66 is not aligned with hot water through passage 26 so that such passage 26 is blocked or closed. Similarly, when valve spool member 65 is rotated 90° so that spool member passage 66 is aligned with hot water through passage 26 to open and allow flow through passage 26, FIG. 3*a*, spool member passage 67 is not aligned with upper bypass passage 31 so that such passage 31 is blocked or closed.

Figure 10:
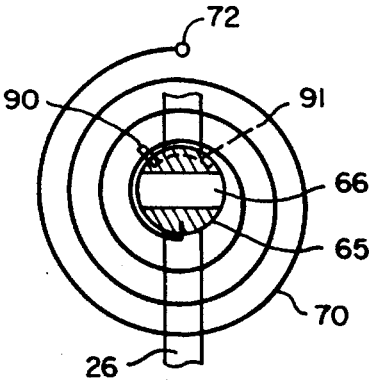
Figure 12:
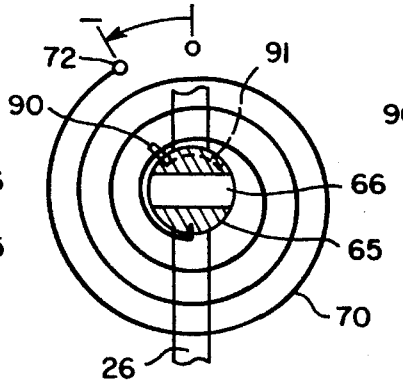
Figure 14:
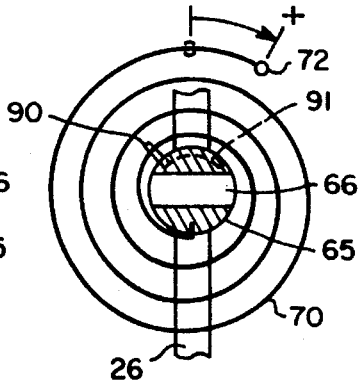
Figure 11:
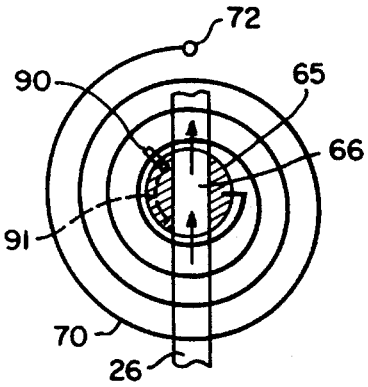
Figure 13:
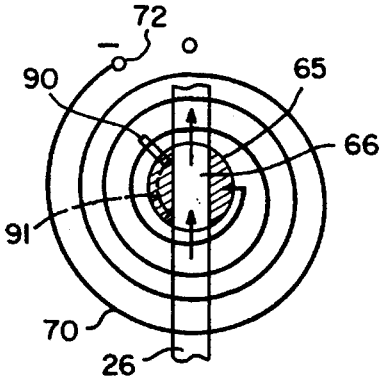
Figure 15:
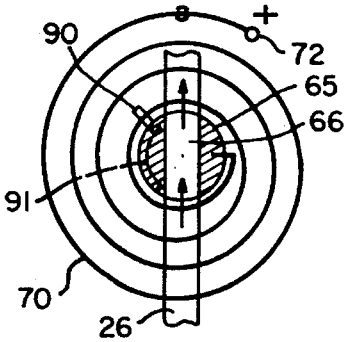
Figure 6:
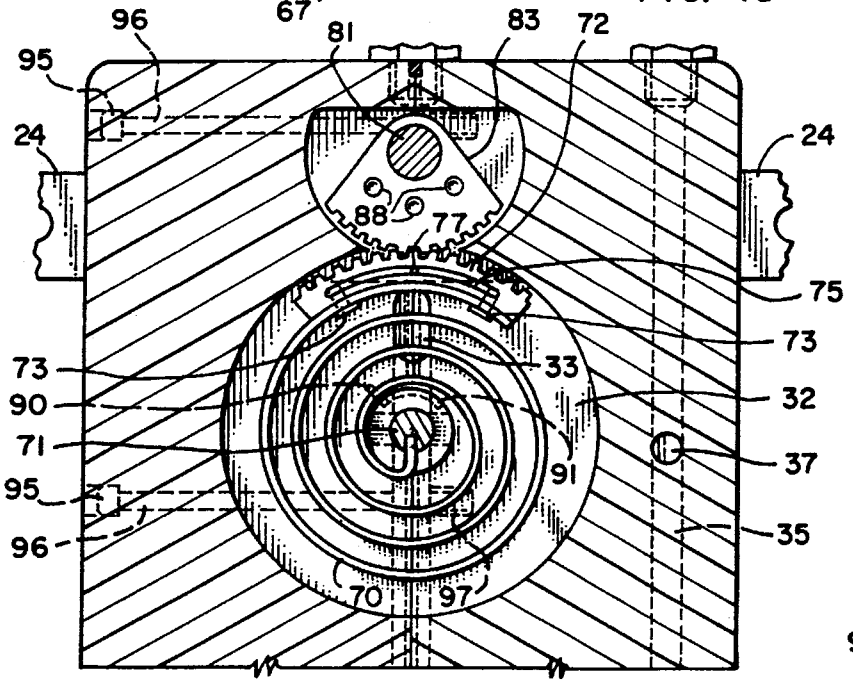

Valve spool member 65 is rotated and controlled by a helical bimetallic thermostat spring element 70, see particularly FIGS. 3 and 6, attached at its inner end to a central reduced diameter portion 71 of valve member 65 and having a rack segment 72 attached to its outer end, as by rivets 73. Rack segment 72 includes arcuate grooves 75 on opposite sides thereof and housing halves 19*a* and 19*b* include recesses 76 in which positioning pins 77 are placed to extend from housing halves 19*a* and 19*b* into grooves 75 to hold rack segment 72 in position at a fixed radius from the central axis of valve member 65. The position of rack segment 72 and the attached end of bimetallic thermostat element 70 may be adjusted by temperature adjustment knob 25. Knob 25 has a shaft 80 extending therefrom and extending rotatably through a receiving passage 81 in body halves 19*a* and 19*b*. A sector gear 83 is mounted in the upper portion of receiving compartment 32 and is attached to knob shaft 80 so that it rotates with temperature control knob 25. Rotation of temperature control knob 25 causes rotation of sector gear 83. Sector gear 83 meshes with rack segment 72 so that rotation of sector gear 83 causes rack segment 72 to move in an arc guided by pins 77 in grooves 75. Thus, rotation of knob 25 causes movement of the rack segment 72 and the end of bimetallic thermostat spring element 70 attached thereto between a central position shown in FIGS. 6, 10, and 11, a counterclockwise rotated position as shown in FIGS. 12 and 13, and a clockwise rotated position as shown in FIGS. 14 and 15. A spring loaded holding element 85, FIG. 3, mounted in opening 86 and biased toward sector gear 83 by spring 87, cooperates with depressions 88, FIG. 6, in the face of sector gear 83 to hold such gear in rotated or central positions. Additional depressions could be provided to hold sector gear 83 in adjusted positions between the extremes shown. A stop pin 90, FIG. 6 and 10–15, extends from housing half 19*a* into a slot 91, FIGS. 3, 4*a*, 6, and 10–15, in valve member 65 to limit the rotation of valve member 65 to 90° and stop rotation in one direction when spool passage 67 is aligned with upper bypass passage 31 as shown in FIG. 3, and to stop rotation in the opposite direction when spool passage 66 is aligned with hot water through passage 26 as shown in FIG. 3*a*. While adjustability of the thermostat spring element 70 is presently preferred, it is not necessary. The positioning of the outer end of spring element 70 could be fixed in a factory set position to operate the valve to open hot water passage 26 in a factory set temperature range.

While the rack segment 72 is shown as slidably positioned and held at a constant radius from the central axis of valve spool member 65 by pins 77 in grooves 75, the rack segment could be positioned by extending supporting side segments from the sides of the rack to valve spool member 65 on both sides of the bimetallic thermostat element 70. Such sides would be rotatable mounted on valve spool member 65.

During assembly of the device, the motor and pump assembly, the valve assembly, adjustment knob, and various pins are placed into one of the housing halves 19*a* or 19*b*. The other half is then moved into position against that half so that the various parts fit into the receiving recesses of the other half and the two halves come together in abutting relationship. A gasket 94, FIG. 3, is placed around the edges of the half as shown and cap screws 95 are inserted through receiving holes 96 in half 19*a* and screwed into threaded sleeves 97 molded or otherwise secured in half 19*b*. By tightening cap screws 95, the halves 19*a* and 19*b* are secured together in water-tight manner. Rather than gasket 94 extending around the housing half edges, a gasket covering substantially all abutting surfaces of the halves may be used or a gasket material may be painted onto the abutting surfaces. The ends of hot water through passage 26 are internally threaded and threaded nipples 98 and 99 are screwed thereinto and secured in place by nuts 100 to form hot water inlet 20 and hot water outlet 21. Similarly, the ends of cold water through passage 35 are internally threaded and threaded nipples 101 and 102 are threaded thereinto and secured in place by nuts 100 to form cold water inlet 22 and cold water outlet 23. The nipples allow easy connection of the device into the water lines.

Figure 16:
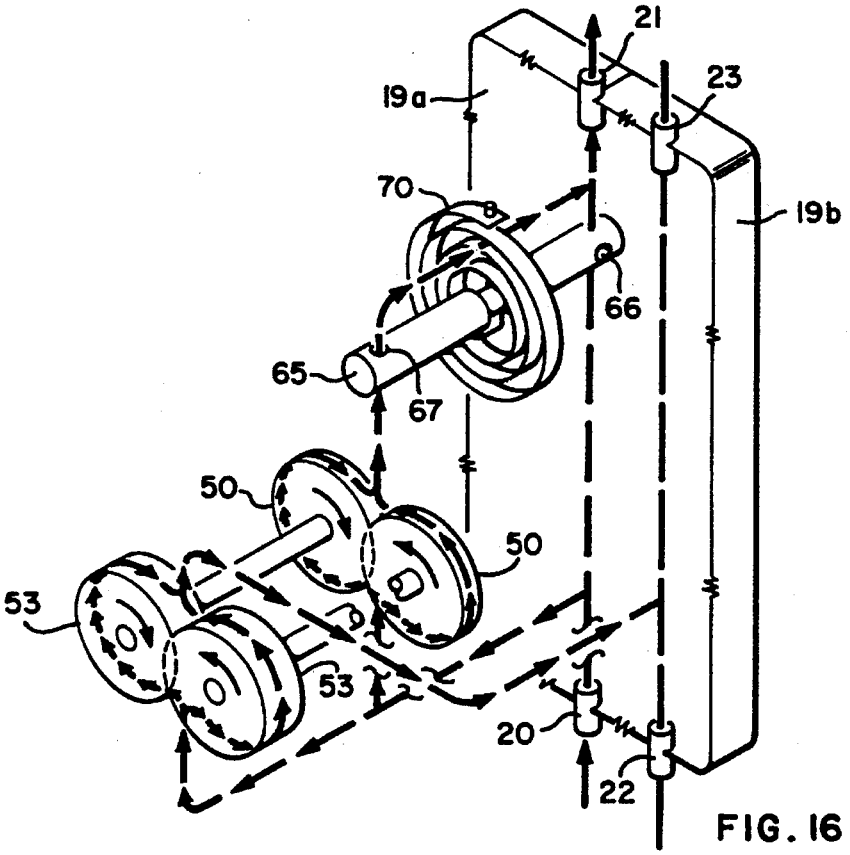
Figure 17:
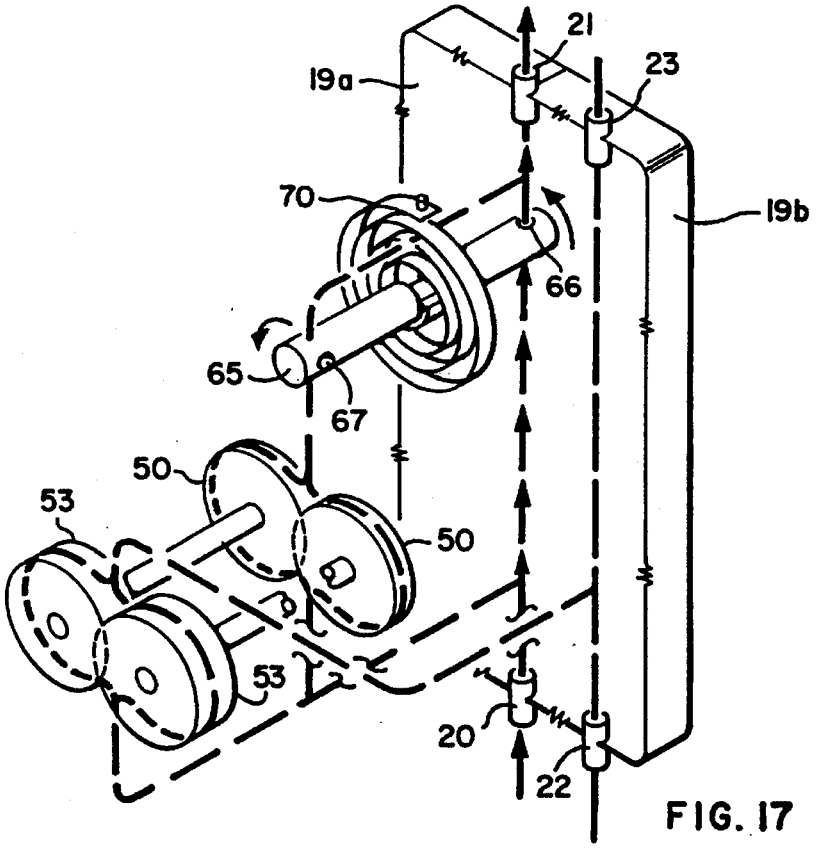

The device has two modes of operation, a pump mode as best seen in FIG. 16, and a normal flow mode as best seen in FIG. 17.

The pump mode is entered as the water in the hot water line at the device cools to ambient temperature when no hot water flows through the device, i.e., after a period of nonuse of hot water. The pump mode is characterized by alignment of valve spool member passage 67 with the upper bypass passage 31, FIGS. 8 and 16. The hot water through passage 26 is blocked or closed.

When a consumer turns on the hot water tap (not shown), the water pressure at the hot water outlet 21 is reduced. Water will flow through the device as shown by the arrows in FIG. 16. A small amount of the normal flow, about a quarter of the normal flow from the hot water tap has been found satisfactory, will flow through the motor gears 50, through the upper bypass passage 31, into receiving compartment 32 and around the bimetallic spring thermostat element 70 therein, through opening 33 into the upper portion of through passage 26, and out the hot water outlet 21. Flow of water through the motor gears 50 causes those gears to rotate, in turn rotating the pump gears 53. Roughly three-fourths of the normal flow from the hot water tap will be pumped by the pump gears 53 through stub passage 34, passages 36 and 37, and into the cold water through passage 35. This water will flow out the cold water inlet 22 or the cold water outlet 23, whichever has the lower pressure. Thus, if the cold water tap is turned on, the water will flow out the outlet and tap. If the cold water tap is turned off, as will normally be the case, the water from the pump will be forced through cold water inlet 22 into the cold water supply pipe.

While in the pump mode, mechanical energy is extracted by motor gears 50 through the flow of water at a high, typically fifty to one hundred pounds per square inch, pipe pressure at the hot water inlet 20 into a substantially lower pressure at the hot water outlet 21. This mechanical energy is used to pump water from the hot water inlet 20 into the cold water line, where the cold water line is at a pressure substantially equal (typically within 10 pounds per square inch) to the pressure at the hot water inlet 20.

When the cool water is purged from the hot water line, and hot water reaches the unit, the increased temperature of the water circulating in compartment 32 around the thermostat spring element 70 is sensed by such thermostat spring element 70. The thermostat spring element 70 extends under the influence of the warm water to rotate valve spool member 65 such that spool member passage 67 is no longer aligned with upper bypass passage 31 and such passage is blocked or closed, and spool member passage 66 is aligned with hot water through passage 26. Rotation of the valve into this position places the device in the normal flow mode. In order to increase the responsiveness of the device, passage 105 may be provided extending from upper bypass passage 31 into the lower portion of receiving compartment 32 which houses bimetallic thermostat spring element 70 to ensure that cold water does not get trapped in this lower portion of the compartment around spring element 70.

In the normal flow mode, as shown in FIG. 17, hot water flows through the hot water inlet 20, thorough hot water through passage 26, through valve spool member passage 66 aligned with through passage 26, and out the hot water outlet 21. Water flow through the motor gears 26 is substantially prevented by the misalignment of valve spool member passage 67 with upper bypass passage 31 which closes such passage 31, thereby preventing flow in either direction through pump gears 27. A small flow through motor gears 50 may continue to take place through passage 105 which remains open, but since full pressure is now in through passage 26 at opening 33, such flow will be very small. The increased flow from the hot water tap will alert the consumer using the water to the fact that hot water is then available at the tap.

When flow of hot water stops for a period of time, and the water in compartment 32 around spring 70 cools (this cooling will be similar to the cooling of the water in the hot water supply pipe), spring 70 will contract to rotate valve spool member 65 to again close hot water through passage 26 and open upper bypass passage 31 thereby putting the device in the pump mode.

The hot water temperature at which the transition between the pump mode and the normal flow mode occurs may be adjusted through rotation of adjustment knob 25. Rotation of the adjustment knob 25 changes the compression on thermostat spring 70 as explained above. This change in compression changes the amount of extension as contraction of the spring necessary to operate (rotate) valve spool member 65. Rotation of the control knob 25 from an intermediate position shown in FIG. 10 in a counterclockwise direction as shown in FIG. 12 will decrease the compression of spring 70 so that less extension of the spring element 70 is necessary to rotate the valve to open through passage 26, FIG. 13. This means that such rotation will take place at a lower temperature of the hot water. Rotation of the control knob 25 in a clockwise direction as shown in FIG. 14 will increase the compression of spring element 70 requiring greater extension of spring element 70 to rotate the valve to open through passage 26, FIG. 15. This means that such rotation will not take place until a higher temperature of the water is reached.

In an alternative embodiment of the invention, the hot water may flow from the hot water inlet through the bimetallic thermostatic element before the water flows through the pump or the valve. Similarly, it is possible that the device be configured such that water from the hot water inlet 20 flows through the valve before it passes through the motor gears.

In addition, it is not necessary to have a cold water through passage in the device. It is only necessary to have a cold water outlet for the cold water pumped from the hot water lines. In such case, an external T connection must be installed in any nearby cold water pipe (not shown) such that water from the cold water outlet may be pumped into that cold water pipe.

The invention also includes the method of conserving water by using a portion of the water normally flowing from a hot water tap to operate a hydraulic motor. The hydraulic motor in turn operates a pump to pump the water not used by the motor that would also normally flow from the tap and be wasted into a cold water line.

Whereas this invention is here illustrated and described with reference to embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A method of conserving water by pumping cold water in a hot water line into a cold water line when hot water is desired from a hot water tap, comprising:

connecting a water pump which is operated by a hydraulic motor between a hot water line and a cold water line near a hot water tap where hot water is desired;

directing water from the hot water line through the hydraulic motor to operate the water pump when the hot water tap is opened to obtain hot water, the water pump thereby pumping a portion of the water that would normally flow from the open tap into the cold water line so that only a portion of the normal flow flows from the hot water tap;

sensing when the water in the hot water line near the tap reaches a predetermined temperature; and stopping the pump and allowing normal flow of water from the hot water tap when the sensed temperature of the water near the tap reaches the predetermined temperature.

2. Apparatus for pumping cold water in a hot water line into cold water line, comprising:

a hot water inlet;

a hot water outlet;

at least one cold water connection;

a hydraulic motor;

a water pump actuated by the hydraulic motor, wherein the pump is connected to pump water from the hot water inlet to the cold water connection;

a valve having one position wherein water is directed from the hot water inlet to the hydraulic motor and water pump, and another position wherein the water is allowed to flow from the hot water inlet to the hot water outlet bypassing the hydraulic motor and pump; and a temperature sensing element for sensing the temperature of water flowing into the apparatus from the hot water inlet and for controlling the valve, whereby the valve directs water to the hydraulic motor and pump when the temperature of the water flowing into the apparatus from the hot water inlet is below the preset temperature, and allows flow of the water from the hot water inlet to the hot water outlet bypassing the hydraulic motor and pump when the water flowing into the apparatus from the hot water inlet is above the preset temperature.

3. The apparatus of claim 2, further comprising an adjustment mechanism such that the preset temperature may be adjusted.

4. The apparatus of claim 3, wherein the temperature sensing element is a bimetallic spring that extends and contracts in response to the temperature of the spring and that is connected to operate the valve, and the adjustment mechanism is means for adjusting the tension of the spring.

5. The apparatus of claim 4, wherein the bimetallic spring is a helical spring having an inner end and an outer end, wherein the valve is operated by a rotatable valve spool connected to the inner end of the spring, and wherein the adjustment mechanism moves the position of the outer end of the spring.

6. The apparatus of claim 5, wherein at least a portion of the water flowing into the apparatus from the hot water inlet flows in contact with at least a portion of the spring.

7. The apparatus of claim 6, wherein the valve substantially blocks water flow through the hydraulic motor when the valve is in the other position.

8. The apparatus of claim 7, wherein the pump will prevent water flow therethrough unless the hydraulic motor is operating.

9. The apparatus of claim 8, wherein the apparatus includes a housing having the hot water inlet and hot water outlet, and wherein the at least one cold water connection is a cold water inlet and a cold water outlet.

10. The apparatus of claim 9, wherein the hydraulic motor is a gear type hydraulic motor.

11. The apparatus of claim 10, wherein the water pump is a gear type water pump.

12. The apparatus of claim 2, wherein the valve substantially blocks water flow through the hydraulic motor when the valve is in the other position.

13. The apparatus of claim 2, wherein the pump will prevent water flow therethrough unless the hydraulic motor is operating.

14. The apparatus of claim 2, wherein the apparatus includes a housing having the hot water inlet and hot water outlet, and wherein the at least one cold water connection is a cold water inlet and a cold water outlet.

15. The apparatus of claim 2, wherein the hydraulic motor is a gear type hydraulic motor.

16. The apparatus of claim 2, wherein the water pump is a gear type water pump.

17. The apparatus of claim 2, wherein the temperature sensing element is a bimetallic spring that extends and contracts in response to the temperature of the spring and that is connected to operate the valve.

18. The apparatus of claim 17, wherein the bimetallic spring is a helical spring having an inner end and an outer end, wherein the valve is operated by a rotatable valve spool connected to the inner end of the spring.

19. The apparatus of claim 17, wherein at least a portion of the water flowing into the apparatus from the hot water inlet flows in contact with at least a portion of the spring.

* * * * *